US007114442B2

(12) United States Patent
Reder et al.

(10) Patent No.: US 7,114,442 B2
(45) Date of Patent: Oct. 3, 2006

(54) CHAMBER DOCTOR BLADE DEVICE FOR INKING A ROLLER HAVING DELIVERY LINES RECEIVED IN END AREAS OF THE DOCTOR BLADE

(75) Inventors: Wolfgang Otto Reder, Veitshöchheim (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/495,750

(22) PCT Filed: Nov. 22, 2002

(86) PCT No.: PCT/DE02/04288

§ 371 (c)(1),
(2), (4) Date: May 27, 2004

(87) PCT Pub. No.: WO03/047864

PCT Pub. Date: Jun. 12, 2003

(65) Prior Publication Data

US 2005/0016398 A1 Jan. 27, 2005

(30) Foreign Application Priority Data

Nov. 28, 2001 (DE) ..... 101 58 157

(51) Int. Cl.
*B41F 31/04* (2006.01)

(52) U.S. Cl. ..... 101/366; 101/350.5; 101/350.6; 101/351.6

(58) Field of Classification Search ..... 101/350.1, 101/350.5, 350.6, 351.1, 351.3, 351.4, 351.6, 101/352.01, 352.04, 352.05, 352.09, 364, 101/366, 367

See application file for complete search history.

(56) References Cited

U.S. PATENT DOCUMENTS

| | | | | |
|---|---|---|---|---|
| 2,018,193 A | | 10/1935 | Smith | |
| 2,931,297 A | * | 4/1960 | Coudriet | 101/157 |
| 4,590,855 A | | 5/1986 | Schommer et al. | |
| 5,012,736 A | * | 5/1991 | Van Kanegan et al. | 101/211 |

(Continued)

FOREIGN PATENT DOCUMENTS

| | | |
|---|---|---|
| DE | 587039 | 10/1933 |
| DE | 1 140 206 | 7/1963 |
| DE | 89 12 194.5 U1 | 1/1990 |
| DE | 40 01 734 A1 | 7/1991 |

(Continued)

*Primary Examiner*—Leslie J. Evanisko
(74) *Attorney, Agent, or Firm*—Jones, Tullar & Cooper, P.C.

(57) ABSTRACT

An inking unit for the printing couple of a double width printing press includes at least one roller. The inking unit consists of at least one, and possibly two chamber doctor blades. If there are two such chamber doctor blades, they are positioned side-by-side in an axial direction of the roller and they can operate independently of each other. If there is only one chamber doctor blade, it can have a length sufficient to enable the side-by-side positioning of at least four newspaper pages. The chamber doctor blade or blades can be positioned against or out of contact with the roller.

12 Claims, 3 Drawing Sheets

U.S. PATENT DOCUMENTS

| | | | | |
|---|---|---|---|---|
| 5,054,392 | A * | 10/1991 | Greenwood | 101/142 |
| 5,297,490 | A | 3/1994 | Schneider et al. | |
| 5,388,515 | A | 2/1995 | Schneider et al. | |
| 5,410,961 | A * | 5/1995 | DeNicola et al. | 101/363 |
| 5,642,664 | A | 7/1997 | Schneider | |
| 6,276,270 | B1 * | 8/2001 | Leanna | 101/350.6 |
| 6,393,983 | B1 * | 5/2002 | Iijima et al. | 101/350.1 |

FOREIGN PATENT DOCUMENTS

| | | |
|---|---|---|
| DE | 42 13 669 A 1 | 4/1992 |
| DE | 42 13 662 C2 | 7/1995 |
| DE | 44 40 040 A1 | 5/1996 |
| DE | 197 15 541 A1 | 10/1998 |
| GB | 516716 | 1/1940 |

* cited by examiner

CHAMBER DOCTOR BLADE DEVICE FOR INKING A ROLLER HAVING DELIVERY LINES RECEIVED IN END AREAS OF THE DOCTOR BLADE

FIELD OF THE INVENTION

The present invention is directed to a device for inking a roller. At least one chamber doctor blade is placed against the roller for inking it.

BACKGROUND OF THE INVENTION

DE 44 40 040 A1 discloses an inking unit with a screen roller and a doctor blade. The doctor blade supplies the screen roller with ink.

An inking unit with a doctor blade extending over the entire length of a screen roller is shown in DE 40 01 734 A1 C2. The doctor blade has an inlet in one area near an end and an outlet in another area near an end for the ink.

SUMMARY OF THE INVENTION

The object of the present invention is directed to providing a device for inking a roller.

In accordance with the present invention, this object is attained by providing at least one chamber doctor blade which can be placed against the roller for inking the roller. Ink delivery lines or conduits are connected to the chamber doctor blade near both of its ends. The chamber doctor blade is supported so that it is pivotable about a shaft. The chamber doctor blade may have a length of at least four side-by-side newspaper pages. An outlet for excess ink may be provided in a center area of the chamber doctor blade. A pump may be assigned to each of the ink delivery lines or conduits.

The advantages to be gained by the present invention lie, in particular, in that the ink supply to the roller to be inked takes place in a compact, cost-effective and rugged manner at high quality.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
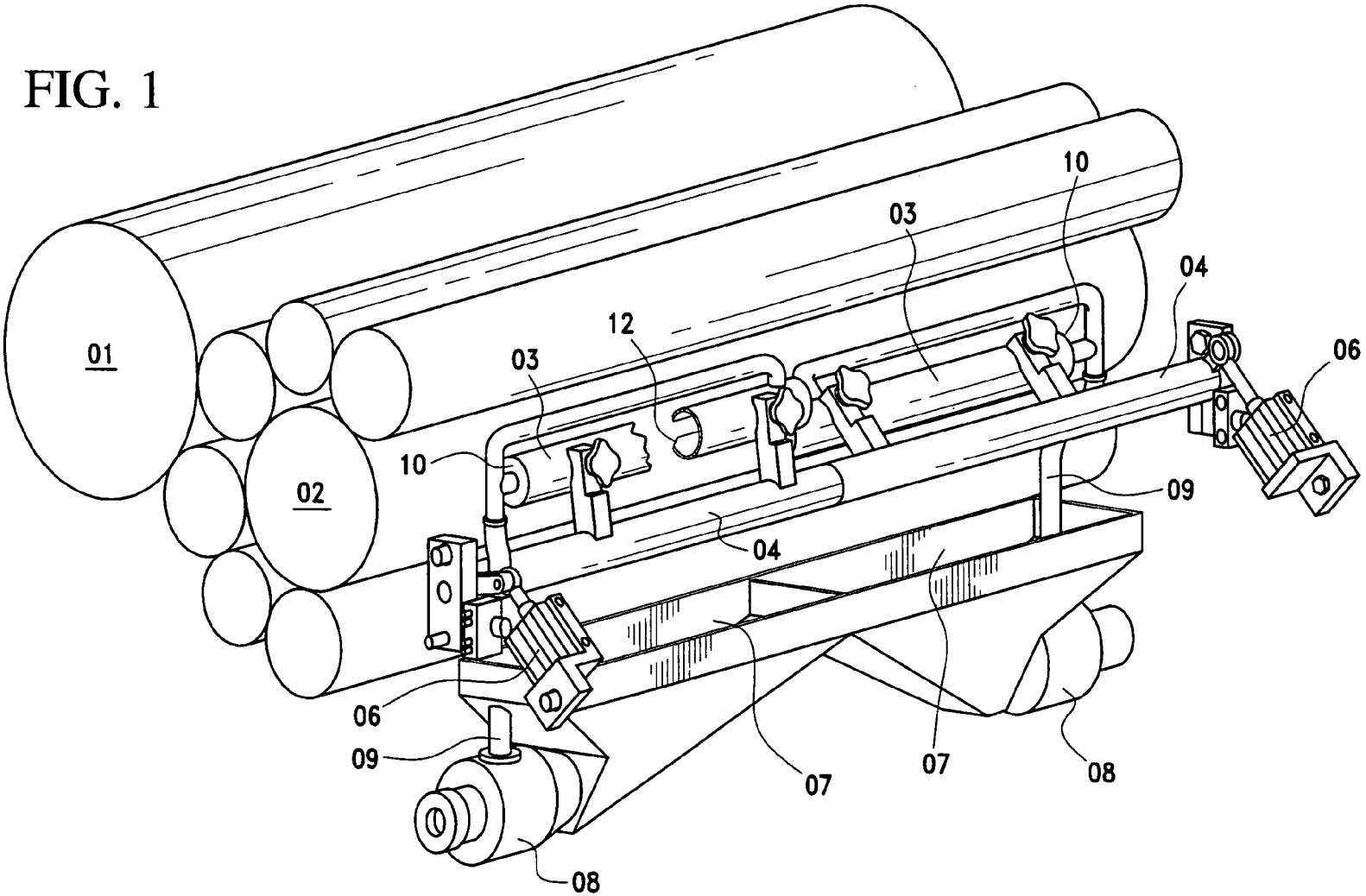
FIG. 1, an ink delivery device in accordance with the present invention by the use of two chamber doctor blade bars, in FIG. 2, an ink delivery by the use of a continuous doctor blade bar, in FIG. 3, a schematic side elevation view of a delivery device, and in FIG. 4, a side elevation view of an alternative device for the delivery of the ink to the doctor blade bar in accordance with the present invention.

A printing group having a forme cylinder 01 is embodied, for example, as a double-width printing group of a printing press and has, as may be seen in FIG. 1, for example, in addition to application rollers and reciprocably-moving rollers, a roller 02, and in particular a screen roller 02, to which ink can be applied by the use of at least one doctor blade 03, which may be, for example, a chamber doctor blade 03. By use of the chamber doctor blade 03, ink can possibly also be applied directly to a printing forme, for example a rotogravure printing forme, of a roller 01 embodied as a forme cylinder 01. The printing group, and therefore the forme cylinder 01, are embodied to have a double width. The printing group has a length substantially corresponding to four side-by-side arranged printed pages, and in particular a length corresponding to the width of four vertical newspaper pages. In an advantageous embodiment, the printing group is configured as an offset printing group, so that the forme cylinder 01 works together with a transfer cylinder, which is not specifically represented, which transfer cylinder, in turn, works together, via the material to be imprinted, with a counter-pressure cylinder. The forme cylinder 01 has on its circumference one or several printing formes for planographic printing.

In the first preferred embodiment, as seen in FIG. 1, two chamber doctor blades 03 are arranged side-by-side over the length of the forme cylinder 01. These two chamber doctor blades 03 are each supported on a shaft 04. In the first preferred embodiment, the shaft 04 is divided into two shaft segments so that each of the two chamber doctor blades 03 can be individually brought into or out of contact with the roller by that chamber doctor blade's shaft segment being pivoted. An actuating assembly 06, or a positioning mechanism 06, which is configured as a pressure medium cylinder and a lever mechanism, is connected to each shaft segment 04. Each of the two actuating assemblies06 are preferably configured so that they can be remote-controlled. Excess ink from each chamber doctor blade 03 drips or runs from a central excess ink outlet 12 into a respective one of a pair of catch containers 07, one of which is arranged underneath each respective chamber doctor blade 03. These catch containers 07 may be, for example, basins 07, whose bottoms slope in such a way that the excess ink preferably runs into the lowest area. In this area of each basin 07, the ink is returned to the respective chamber doctor blade 03, and in particular to an outlying or end area 10 of that respective doctor blade 03, by at least one pump 08 via a delivery line 09, as seen in FIGS. 1 and 3. As also depicted in FIG. 2, and as described in connection therewith, ink can be delivered to each chamber doctor blade 03, in each of the two end areas 10 of each chamber doctor blade 03 near the ends of each chamber doctor blade 03.

Figure 2:
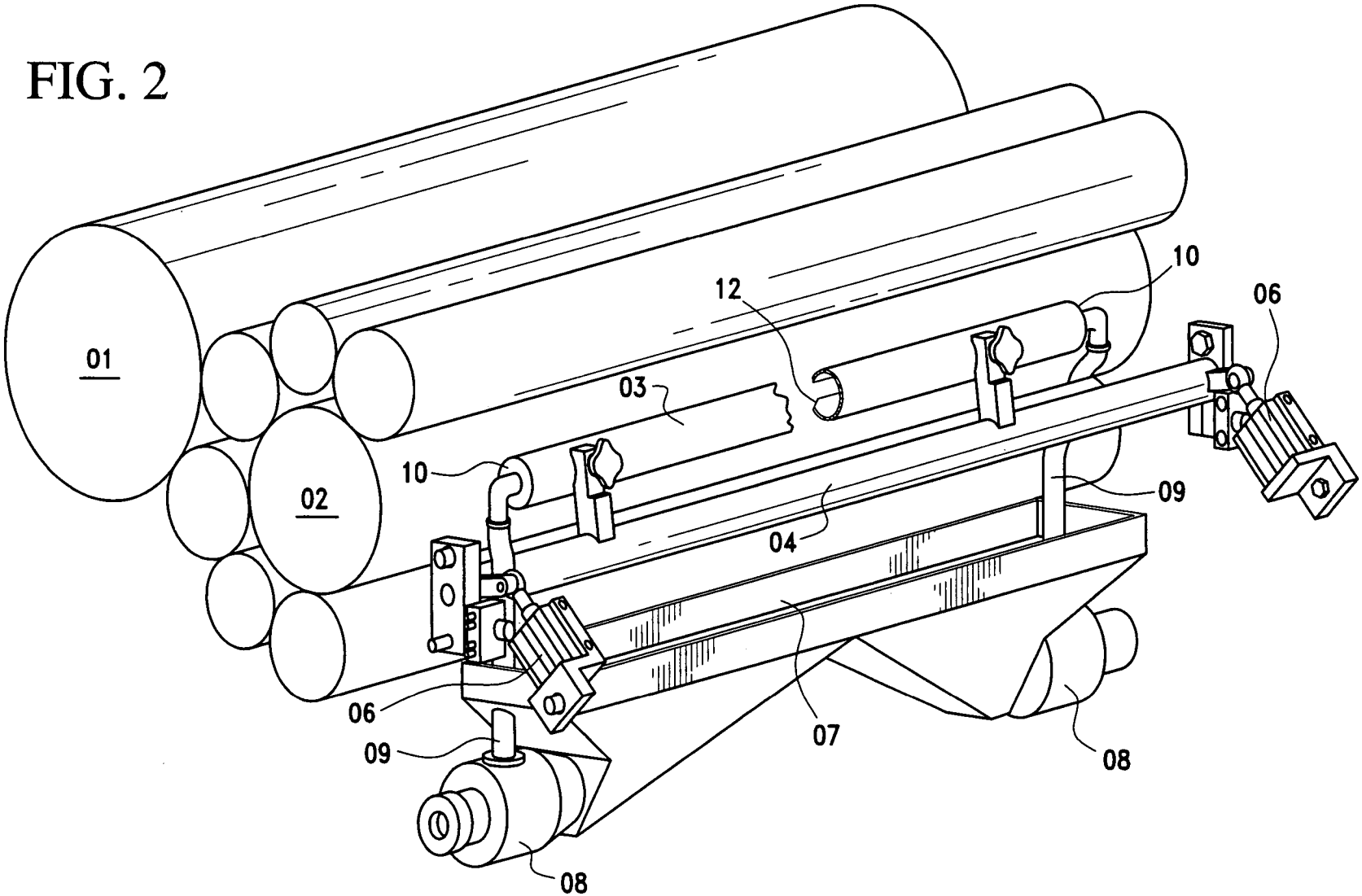
Figure 3:
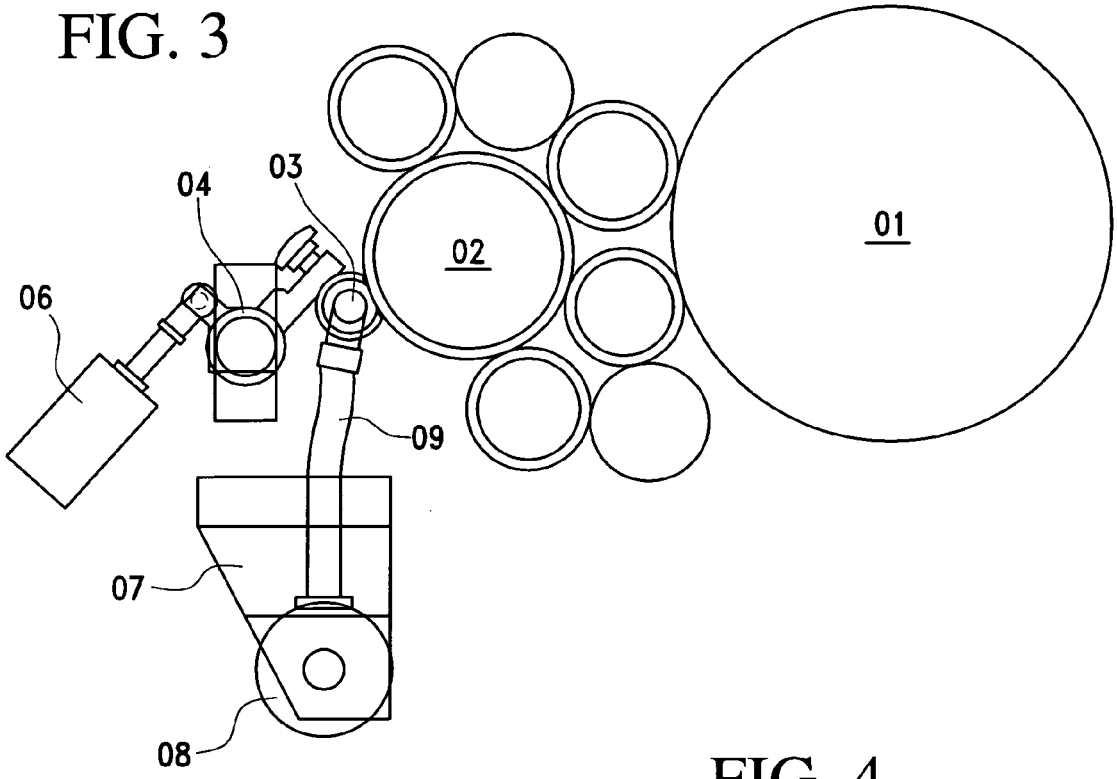

In a second preferred embodiment, as shown in FIG. 2, the ink delivery device has a chamber doctor blade 03 extending over the entire length intended for printing, for example a length of four printed pages arranged side-by-side, which sole chamber doctor blade 03 is arranged on a continuous and pivotable shaft 04. In the second preferred embodiment represented in FIG. 2, two pumps 08 and two delivery lines 09 are provided. These are located, in particular, at both sides of a basin 07, which basin 07 also extends over the entire length intended for printing, which two pumps 08 deliver the excess ink to the chamber doctor blade 03, and, in particular, to each one of two end areas 10 near the two chamber doctor blade ends. The excess ink can run off in the center area of the chamber doctor blade 03, and in particular through an excess ink outlet 12 especially provided for this purpose. In this way, eddies, possibly caused by the ink flow, are preferably located in anon-printing area between two printed pages. The tubular shape of the chamber doctor blade 03 as seen in FIGS. 1 and 2, which is configured with a cross section in the shape of a circle, with an axially extending slit, which slit defines a working doctor blade and a chamber doctor blade also helps in preventing irregularities of the flow and in preventing the sticking of the ink in corner and edge areas of the chamber doctor blade 03. By the embodiment of the chamber doctor blade 03 extending over the entire length intended for printing, it is possible to ink the roller 02 continuously, i.e. without a stripe. Actuation of the chamber doctor blade 03 is provided preferably by the provision of two actuating assemblies 06 assigned to the chamber doctor blade 03, and in particular by remote-controlled actuating assemblies.

The chamber doctor blade or blades 03 is or are preferably embodied in the shape of a slit tube as the doctor blade chamber which slit tube, in an advantageous manner, has a working doctor blade and a closing doctor blade in the area of the two spaced, axially extending edges of the slit in the tube, as may be seen in FIGS. 1 and 2.

In a further development, it is possible, with an appropriately stiff or rigid construction of the chamber doctor blade 03, for the pivoting in and out of the one-piece chamber doctor blade 03 to take place by the use of only one actuating assembly 06, positioned for example, on one of the two sides or ends 10 of the chamber doctor blade 03, or located in the center of the chamber doctor blade 03. The delivery of ink to the chamber doctor blade 03 can also take place by the use of only one pump 08 and two delivery lines 09, or possibly by the use of only one pump 08 and only one delivery lines 09.

Figure 4:
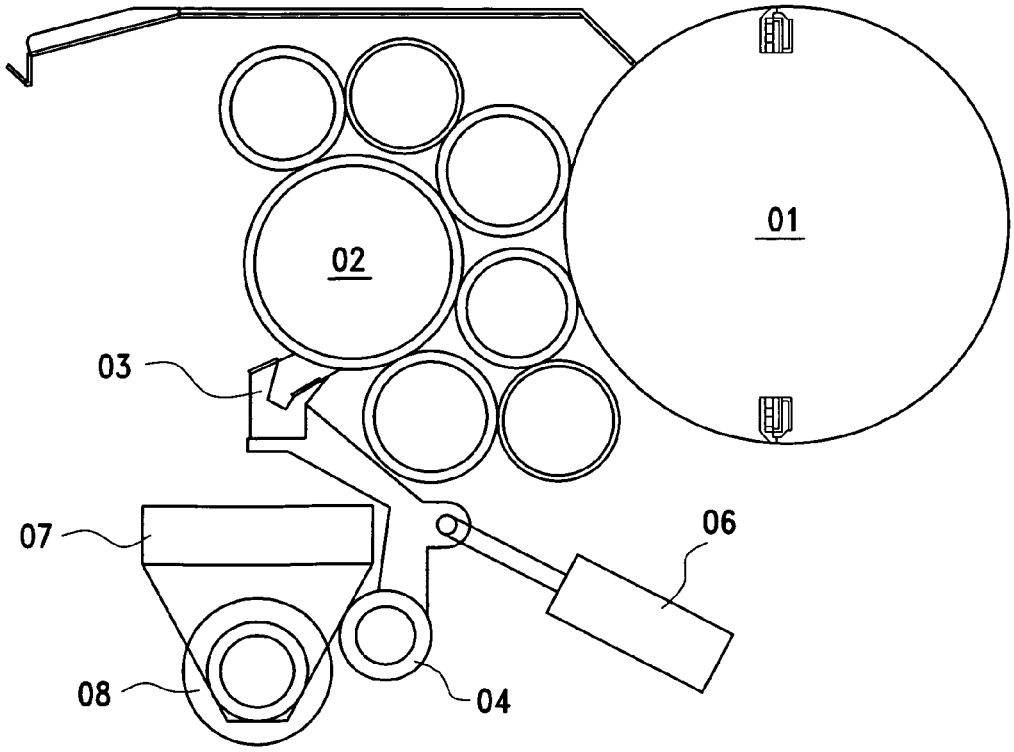

As represented in FIG. 3, the movement of the chamber doctor blade, or blades 03 in and out of contact with the roller 02 takes place, corresponding to FIGS. 1 and 2, around the shaft, or shafts 04 positioned close to the roller 02. The delivery line 09 is embodied to be flexible, for example, and in particular is embodied as a hose 09. Alternatively, it can also be of advantage to arrange the pivot axis of the actuating assembly 06 at the height of the basin, or basins 07, as represented in FIG. 4. In this configuration, the ink can be delivered in a non-movable rigid line, which is not specifically represented here, and wherein a rotatable coupling must be provided in the area of the pivot axis of the chamber doctor blade lever.

In a correspondingly rigid embodiment, the chamber doctor blade 03 depicted in FIG. 2 as extending over the entire width of the roller 02, can also be applied in connection with even wider rollers 01, 02, for example with rollers 01, 02 having a width of six printed pages. In this case, three chamber doctor blades 03, or two chamber doctor blades 03, each extending over respectively two or three printed pages, are arranged side-by-side, for example, in a manner similar to that depicted in the embodiment in accordance with FIG. 1.

While preferred embodiments of a device for inking a roller, in accordance with the present invention, have been described fully and completely hereinabove, it will be apparent to one of skill in the art that various changes in, for example, the type of ink being used, the type of ink pump used and the like could be made without departing from the true spirit and scope of the present invention which is accordingly to be limited only by the appended claims.

What is claimed is:

1. A device for inking a roller comprising:

a chamber doctor blade adapted to be placed against the roller, said chamber doctor blade extending parallel to an axis of rotation of the roller and having first and second ink delivery areas which are spaced apart from each other in a direction of said axis of rotation of the roller at spaced ends of said chamber doctor blade, and having a center excess ink runoff area which is intermediate said first and second axially spaced ends;

first and second delivery lines for delivering ink to said chamber doctor blade, said first and second delivery lines being received in said first and second axially spaced ink delivery areas of said chamber doctor blade;

an excess ink outlet in said center excess ink runoff area of said chamber doctor blade, ink being directed to flow from said first and second ink delivery areas to said excess ink runoff area in a direction of said axis of rotation of the roller; and a chamber doctor blade axial length, said chamber doctor blade axial length being at least that of a double width printing group with four side-by-side arranged vertical newspaper pages.

2. The device of claim 1 further including two of said chamber doctor blades arranged side-by-side in said axial direction of the roller, said two chamber doctor blades together having said chamber doctor blade length.

3. The device of claim 2 further including actuating means for moving each of said two chamber doctor blades into and out of contact with the roller.

4. The device of claim 1 further including a pump for each of said first and second delivery lines.

5. The device of claim 1 further including a pivotable shaft, said chamber doctor blade being seated on said pivotable shaft.

6. The device of claim 5 further including an actuating means for pivoting said pivotable shaft.

7. The device of claim 5 wherein said pivotable shaft is a split shaft.

8. The device of claim 1 further including a catch container extending over said chamber doctor blade axial length and beneath said chamber doctor blade.

9. The device of claim 1 wherein said chamber doctor blade is a tube with an axially extending slit.

10. The device of claim 9 further including first and second slit edges of said slit and defining a working doctor blade and a closing doctor blade in said chamber doctor blade.

11. The device of claim 1 further including actuating means for moving said chamber doctor blade into and out of contact with the roller.

12. A device for inking a roller comprising:

at least one chamber doctor blade adapted to be placed against the roller;

delivery lines for delivering ink to said at least one chamber doctor blade, said at least one chamber doctor blade having end areas, said delivery lines being received in said end areas;

a chamber doctor blade length, said length being at least that of two side-by side arranged vertical newspaper pages; and a pivotable shaft, said at least one chamber doctor blade being seated on said pivotable shaft, said pivotable shaft being a split shaft.

* * * * *